US005561488A

United States Patent [19]

Fyson

[11] Patent Number: 5,561,488

[45] Date of Patent: Oct. 1, 1996

[54] PHOTOGRAPHIC PROCESSING METHOD AND APPARATUS

[75] Inventor: John R. Fyson, Hackney, United Kingdom

[73] Assignee: Eastman Kodak Company, Rochester, N.Y.

[21] Appl. No.: 462,084

[22] Filed: Jun. 5, 1995

[30] Foreign Application Priority Data

Sep. 10, 1994 [GB] United Kingdom ..... 9418277
Apr. 5, 1995 [GB] United Kingdom ..... 9507053

[51] Int. Cl.[6] ..... G03D 13/00

[52] U.S. Cl. ..... 396/578; 396/630

[58] Field of Search ..... 354/322–324, 354/298; 430/30, 398–400

[56] References Cited

U.S. PATENT DOCUMENTS

| | | | |
|---|---|---|---|
| 4,796,042 | 1/1989 | Mappin et al. | 354/324 |
| 5,084,168 | 1/1992 | Woog | 210/202 |
| 5,294,955 | 3/1994 | Frank | 354/324 |
| 5,347,336 | 9/1994 | Yamada et al. | 354/324 |

FOREIGN PATENT DOCUMENTS

| | | | |
|---|---|---|---|
| 271610A1 | 6/1988 | European Pat. Off. | G03D 3/06 |
| 608947A3 | 8/1994 | European Pat. Off. | G03D 3/06 |
| 32250 | 12/1989 | Japan | 354/322 |
| 2158258 | 11/1985 | United Kingdom | G03C 5/39 |
| 2205176 | 11/1988 | United Kingdom | 354/323 |

*Primary Examiner*—D. Rutledge
*Attorney, Agent, or Firm*—J. Lanny Tucker

[57] ABSTRACT

A photographic processing machine having at least two processing tanks for holding different processing solutions and a removable container (100) containing working strength processing solutions and a washing-stabilizing solution in separate sub-containers (10–50) therein from which the processing tanks are fed, wherein the last sub-container that feeds the washing-stabilizing tank comprises electrodes (70 and 80) and, in that when the resistance falls to a predetermined value, an indicator means is activated signalling the necessity for changing the processing solution container.

11 Claims, 2 Drawing Sheets

PHOTOGRAPHIC PROCESSING METHOD AND APPARATUS

FIELD OF THE INVENTION

This invention relates to photographic processing apparatus and to a method of determining when a batch of processing solution(s) needs replacing.

BACKGROUND OF THE INVENTION

Some known small photographic processing machines are supplied with processing solutions by means of a cartridge or cassette of ready-made working strength solution(s). For example, such a multiple cartridge could comprise a color developer solution, a bleach-fix solution and two or three wash and/or stabilizer solutions. Such containers can also contain filter or treatment means. Often such cartridges are returned to the manufacturer for recycling or disposal.

PROBLEM TO BE SOLVED BY THE INVENTION

If the cartridge is to be used in a batch mode, that is supplying a certain amount of a processing solution in order to process a certain area of photographic material before it is discarded, it is not clear when to replace this cartridge. Too early would be wasteful as, in some instances, the average use is better than the worst case that must be provided for. Too late would cause the processing to go out of control and produce undesirable results. More particularly, if the final wash water is contaminated by seasoned bleach-fix carried in from a previous bleach-fix bath, it will be left on the processed material surface. If the amount of bleach-fix becomes too high in the final wash tank, the developed images produced stain after keeping. Merely counting the number of sheets or lengths processed and calculating the "worst case" scenario could result in leaving serviceable solutions in the container. Such a scenario, for example, might assume that every frame is fully exposed thus requiring maximum amounts of developer and bleach-fix.

In such processes where these cartridges are used to supply processing reagents in a batch mode, a means of detection of the end of usefulness of the processing solution is therefore needed.

SUMMARY OF THE INVENTION

According to the present invention, there is provided a method of processing imagewise exposed photographic materials in a processing machine comprising at least two processing tanks including a final stabilizing and washing tank, and a removable container containing at least one working strength solution with processing reagent(s) therein, and a final stabilizing and washing solution in separate sub-containers from which the processing tanks are fed, characterized in that the sub-container that contains the stabilizing and washing solution comprises a means for (a) detecting the amount of the processing reagent(s) in the final stabilizing and washing solution and (b) signalling the need for changing the processing solution sub-container.

Additionally, the present invention provides a photographic processing apparatus comprising at least one processing tank for holding a processing solution, a processing tank containing a final washing solution, and a removable container containing at least one working strength processing solution and a final washing solution in separate sub-containers

ADVANTAGEOUS EFFECT OF THE INVENTION

The processing solution container is changed neither too early nor too late thus saving waste in the former case and improving the quality of the processing in the latter, e.g., when the squeegees have deteriorated.

The present invention is particularly useful in a case where developer carry-over into the bleach-fix bath reduces the bleach-fixing activity of the solution.

When loss by evaporation is small (which is usually the case in small processing machines or minilabs), particularly good results are obtained.

DETAILED DESCRIPTION OF THE INVENTION

Figure 1:
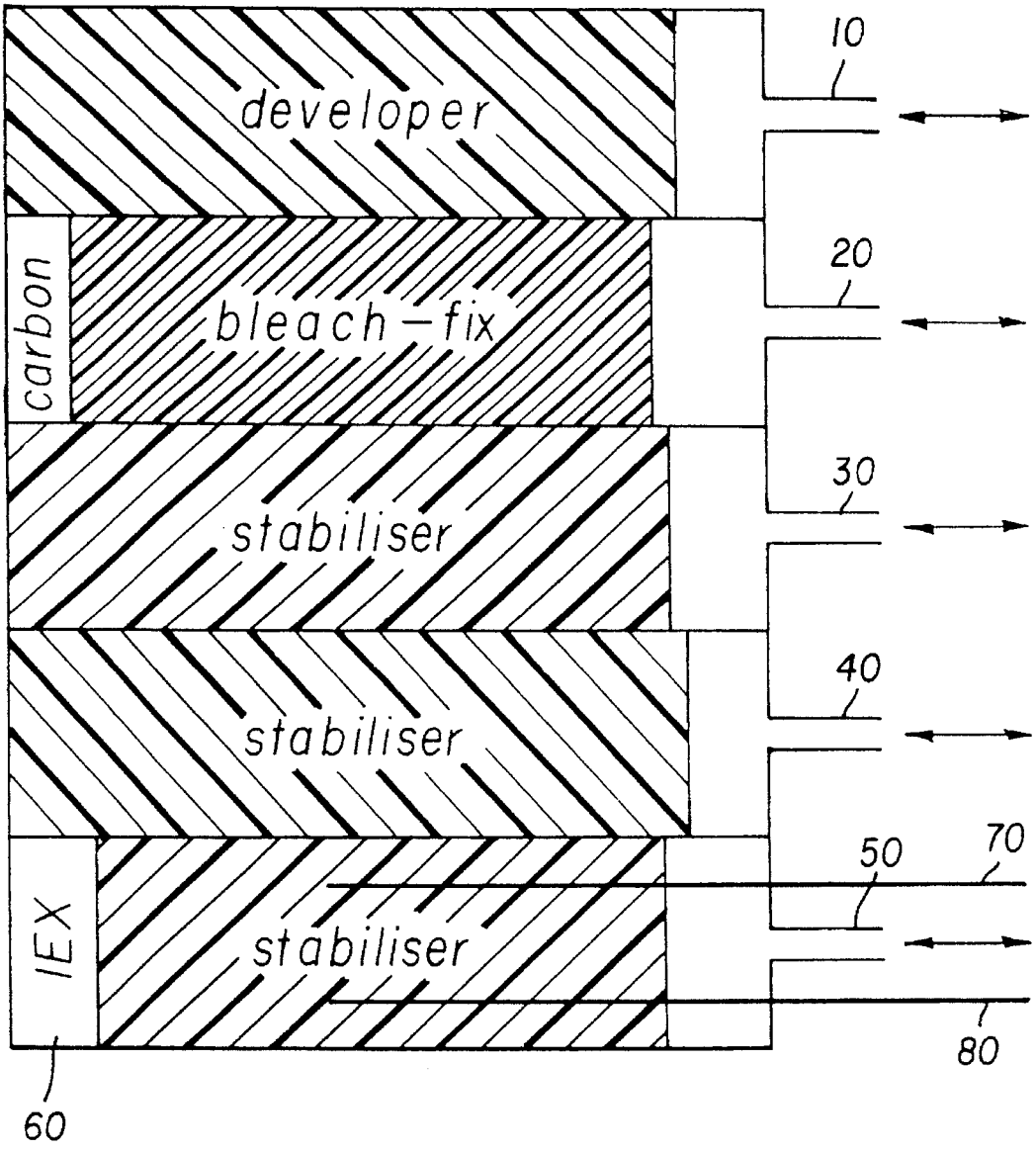
FIG. 1 of the accompanying drawings shows a multicontainer processing solution pack and FIG. 2 shows a plot illustrating the results of Example below.

According to the invention, a detector is located in the final sub-container containing the washing and stabilizing solution. The detector is of the electrical type, that is, measures the resistance or the conductance of the liquid in the sub-container by some means. The means can be electrodes in the sub-container where a decrease in resistivity would indicate an amount of contaminant solution at the level of the electrodes, in the last sub-container. When the resistance falls to a predetermined value, it would indicate that the tank's contents are outside acceptable limits and a signal, or indicator is then activated. The predetermined value is established by routine experiment.

The indicator means may be a bell, buzzer, light or other like means. In addition, as in option 4 above, the level detector and indicator means may be combined as a mark on a transparent part of the sub-container that can be viewed by the operator.

The present invention is suitable for small processing machines, especially those known as minilabs. Such machines are designed to be operated by someone without much knowledge of processing chemistry and are therefore as automatic as possible. A paper processing machine would normally comprise develop and bleach-fix tanks with One or more wash or stabilize tanks.

The process may comprise the steps of:

(a) color development, (b) bleach, (c) fix followed by one or more wash or stabilizer steps, or a similar method in which the bleach and fix baths are combined into a single bleach-fix bath. Preferably, a sub-container feeding a tank used after the image-forming step(s) contains activated charcoal or an ion-exchange resin or mixtures thereof to remove unwanted processing chemicals, for example, color developing agent.

In a particular embodiment, the bleach-fix sub-container contains activated charcoal to remove unwanted color developer carry-over while the last washing stabilizer sub-container, in addition to the electrical detector, contains an ion exchange resin.

In particular, a mixture of anionic and cationic ion exchange resins can be employed.

Alternatively, the process may comprise the steps of:

(a) development, and (b) fix, followed by one or more wash or stabilizer steps. The developer would typically be a black-and-white developer.

A further alternative would be in the case of a redox amplification process in which the first bath is a redox amplification bath or, especially, a redox developer-amplifier bath. Such amplification processes are well known. Redox amplification processes have been described, for example in British Specification Nos. 1,268,126, 1,399,481, 1,403,418 and 1,560,572. In such processes, color materials are developed to produce a silver image (which may contain only small amounts of silver) and then treated with a redox amplifying solution (or a combined developer-amplifier) to form a dye image.

The developer-amplifier solution contains a color developing agent and an oxidizing agent that will oxidize the color developing agent in the presence of the silver image which acts as a catalyst. Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide and compounds that provide hydrogen peroxide, e.g., addition compounds of hydrogen peroxide; cobalt (III) complexes including cobalt hexammine complexes; and periodates. Mixtures of such compounds can also be used.

The materials to be processed and the processes to be used are described in Research Disclosure Item 308119, December 1989, published by Kenneth Mason Publications, Emsworth, Hants, United Kingdom.

This invention can be used to process either color or black and white photographic materials using the appropriate processing steps and compositions. In the accompanying drawings, FIG. 1 shows schematically a removable container containing working strength processing solutions in 5 separate sub-containers. Cartridge 100 contains sub-containers 10–50 that respectively contain the processing solutions: developer, bleach-fix, stabilizer, stabilizer and the final wash-stabilizer. Each solution is supplied to the appropriate processing tank and returned via tubes by circulation means, e.g., a pump, not shown. The detection means comprises two electrodes 70 and 80 that show the variation of the resistance when the liquid between the electrodes is enriched in contaminants carried over from the previous sub-containers. The variation of the resistance beyond a predetermined threshold can trigger an alarm. To extend the useful life of the container, a sub-container such as the bleach-fix sub-container (20) can contain activated charcoal to remove developing agent while the last stabilizer-wash sub-container also contains ion-exchange resin (60) to remove ionic species carried over from previous baths. The system of the invention has the following advantages.

It allows the end of the life of chemical cartridge to be detected via the content of the final wash tank;

It is simple and inexpensive;

It provides an indication of the state of the squeegees; a quick loss of resistance is indicative of poor squeegeeing;

It allows a means to get prints that do not stain any quicker than they would in demineralized water.

This system may be combined with any of the detection methods that could be used in the sub-containers of such an equipment, with a view to detecting particularly the end of usefulness of the cartridge.

The following Example is included for a better understanding of the invention.

EXAMPLE

Unexposed Ektacolor Edge paper was processed through a processor comprising an Ektacolor RA developer tank, an Ektacolor Bleach Fix NR tank, and a wash stabilizer tank filled with demineralized water. Different quantities of bleach-fix were added to the stabilizer in order to simulate a seasoning. After samples of the unexposed paper were processed, the yellow stain was read with a densitometer and they were put in a dark oven at 60° C. and 80% NR. After 9 days of keeping in the oven, the yellow densities of the samples were read again. The table below shows the change in yellow stain between the reading on the fresh samples and on the samples upon keeping.

TABLE

| Bleach-fix Dilution | Yellow Stain Change |
|---|---|
| 250 | 0.070 |
| 500 | 0.077 |
| 1000 | 0.056 |
| 1500 | 0.060 |
| 2000 | 0.025 |
| infinite | 0.025 |

The above results show that at a dilution of 2000, the bleach-fix causes no more keeping stain on a print washed in demineralized water. The final tank was fitted with two stainless steel electrodes, 2 mm in diameter and 1.9 cm long. These two electrodes were lowered into the liquid and the relative resistance of the demineralized water contaminated with the same bleach-fix was measured with an AC resistance meter.

Figure 2:
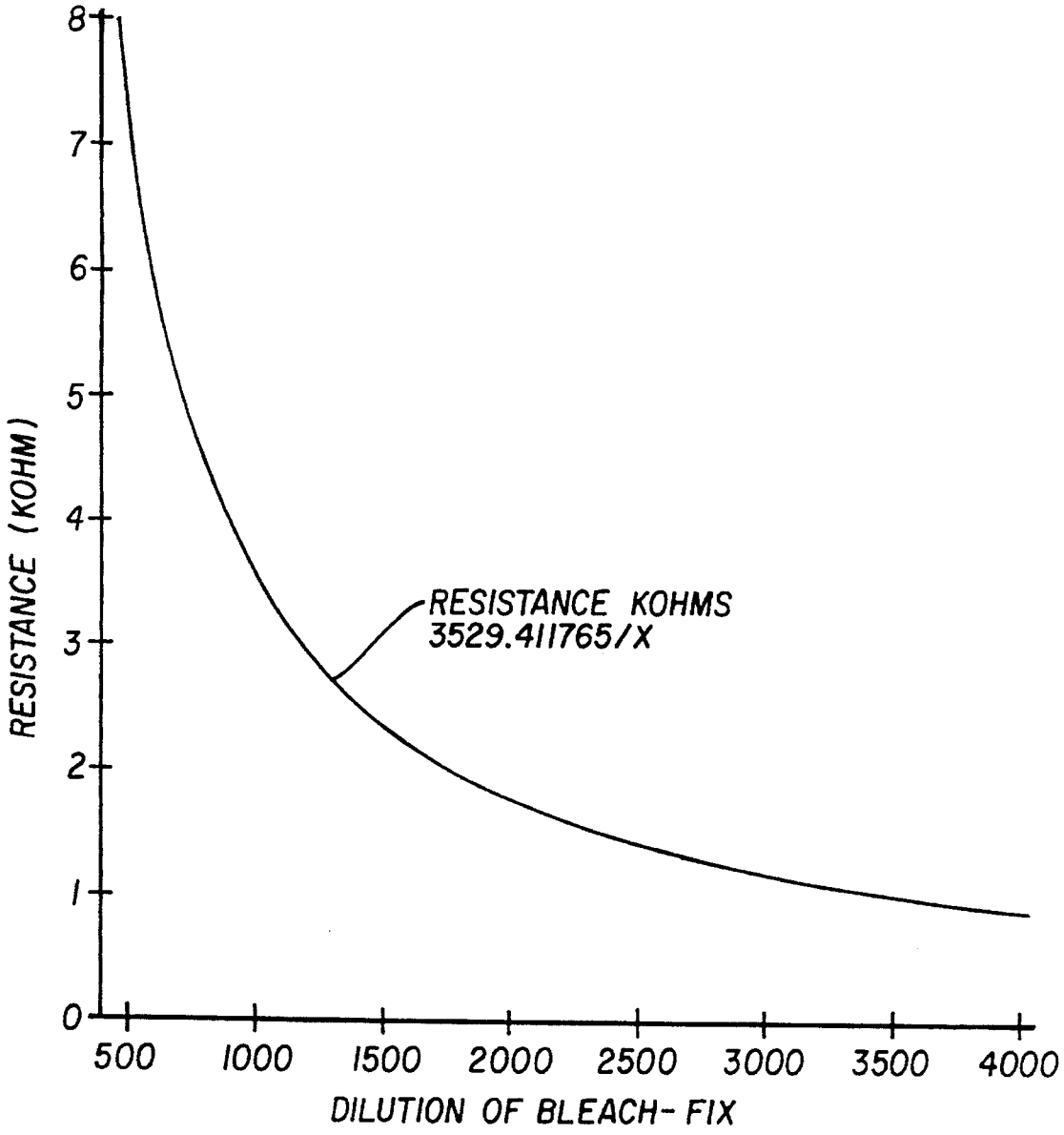

The results of measuring the resistance at different degrees of contamination are shown in FIG. 2. When the resistance falls below 3.6 kohms, corresponding to a dilution of bleach fix higher than 2000, the wash contains too much bleach-fix to give prints that will not stain upon keeping.

The invention has been described in detail with particular reference to preferred embodiments thereof, but it will be understood that variations and modifications can be effected within the spirit and scope of the invention.

I claim:

1. In a method of processing imagewise exposed photographic materials in a processing machine comprising at least two processing tanks including a final stabilizing and washing tank, and a removable container containing at least one working strength solution with processing reagent(s) therein, and a final stabilizing and/or washing solution in separate sub-containers from which the processing tanks are fed, the improvement wherein the sub-container that contains said final stabilizing and/or washing solution comprises a means for (a) detecting the amount of the processing reagent(s) in said final stabilizing and/or washing solution and (b) signalling the need for changing said removable container.

2. The method of claim 1, comprising the steps of:

(a) color development, (b) bleaching, and (c) fixing followed by one or more wash or stabilizer steps, or comprising a bleach-fix step in place of the separate bleach and fix steps.

3. The method of claim 1, comprising the steps of:

(a) development, and (b) fixing, followed by one or more wash or stabilizer steps.

4. The method of claim 1, comprising treatment with a first bath that is a redox amplification bath, or a redox developer-amplifier bath.

5. In a photographic processing apparatus comprising at least two processing tanks for holding processing solutions and a removable container containing at least one working strength processing solution and a stabilizing and/or washing solution in separate sub-containers therein from which the processing tanks are fed, the improvement wherein the sub-container that contains said stabilizing and/or washing solution comprises a means for (a) detecting the amount of the processing reagent(s) in said stabilizing and/or washing solution and (b) signalling the need for changing said removable container.

6. The apparatus of claim 5, comprising means for circulating each processing solution to and from each respective pair of tanks and corresponding sub-containers.

7. In a photographic processing solution cartridge comprising a container containing at least one working strength processing solution and a stabilizing-washing solution in separate sub-containers therein, the improvement wherein the last sub-container containing the stabilizing-washing solution comprises an electrical detector.

8. The cartridge of claim 7, wherein the detector comprises electrodes so that an increase in conductivity of the washing-stabilizing solution between the electrodes indicates a contamination of said solution.

9. The cartridge of claim 7, comprising activated charcoal in a bleach-fixing or fixing sub-container.

10. The cartridge of claim 7, wherein the last wash or stabilizer sub-container contains an ion-exchange resin, or mixture of such resins.

11. The cartridge of claim 7, wherein one of the sub-containers contains activated charcoal.

* * * * *